US009916800B2

(12) United States Patent
Tian et al.

(10) Patent No.: US 9,916,800 B2
(45) Date of Patent: Mar. 13, 2018

(54) METHOD AND APPARATUS FOR CALIBRATING THE BRIGHTNESS FOR ODD AND EVEN ROWS OF A LIQUID CRYSTAL DISPLAY DEVICE

(71) Applicant: Boe Technology Group Co., Ltd., Beijing (CN)

(72) Inventors: Yunyun Tian, Beijing (CN); Hyunsic Choi, Beijing (CN); Zheng Fang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/571,539

(22) Filed: Dec. 16, 2014

(65) Prior Publication Data

US 2016/0148552 A1 May 26, 2016

(30) Foreign Application Priority Data

Nov. 26, 2014 (CN) ..... 2014 1 0688277

(51) Int. Cl.
*G09G 3/36* (2006.01)

(52) U.S. Cl.
CPC ..... *G09G 3/3648* (2013.01); *G09G 3/3696* (2013.01); *G09G 2300/0447* (2013.01);
(Continued)

(58) Field of Classification Search
CPC ..... G09G 3/2003; G09G 3/3696
(Continued)

(56) References Cited

U.S. PATENT DOCUMENTS 5,589,960 A * 12/1996 Chiba ..... G02F 1/13471 349/117
2003/0142055 A1* 7/2003 Iisaka ..... G09G 3/3648 345/89

(Continued)

FOREIGN PATENT DOCUMENTS

CN 102236216 11/2011
CN 103472642 12/2013

(Continued)

OTHER PUBLICATIONS

Office action from Chinese Application No. 201410688277.8 dated Mar. 18, 2016.

(Continued)

*Primary Examiner* — Long D Pham
(74) *Attorney, Agent, or Firm* — Calfee, Halter & Griswold LLP

(57) ABSTRACT

The embodiment of the invention provides a method and an apparatus for calibrating a liquid crystal display device. The liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; the method comprises: measuring brightness of the pixels of odd rows in a plurality of gray scales and brightness of the pixels of even rows in the plurality of gray scales respectively in a predetermined direction; and adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

12 Claims, 4 Drawing Sheets

(52) U.S. Cl.
CPC ..... *G09G 2320/029* (2013.01); *G09G 2320/0233* (2013.01); *G09G 2320/0276* (2013.01); *G09G 2320/0693* (2013.01); *G09G 2330/08* (2013.01)

(58) Field of Classification Search
USPC ..... 345/89, 690
See application file for complete search history.

(56) References Cited

U.S. PATENT DOCUMENTS

| | | | | |
|---|---|---|---|---|
| 2003/0151617 | A1* | 8/2003 | Morita | G09G 3/2011 345/690 |
| 2009/0207106 | A1* | 8/2009 | Mizukoshi | G09G 3/3233 345/76 |
| 2016/0035305 | A1* | 2/2016 | Jin | G02F 1/13454 345/205 |

FOREIGN PATENT DOCUMENTS

| | | |
|---|---|---|
| CN | 103824548 | 5/2014 |
| JP | 2014071128 | 4/2014 |
| KR | 20080076805 | 8/2008 |

OTHER PUBLICATIONS

Office action from Chinese Application No. 201410688277.8 dated Jul. 25, 2016.
Office Action from China Application No. 201410688277.8 dated Dec. 19, 2016.
Decision on Rejection from Chinese Patent Application No. 201410688277.8 dated Apr. 12, 2017.

* cited by examiner

METHOD AND APPARATUS FOR CALIBRATING THE BRIGHTNESS FOR ODD AND EVEN ROWS OF A LIQUID CRYSTAL DISPLAY DEVICE

RELATED APPLICATIONS

The present application claims the benefit of Chinese Patent Application No. 201410688277.8, filed Nov. 26, 2014, the entire disclosure of which is incorporated herein by reference.

FIELD OF THE INVENTION

The present invention relates to the liquid crystal display field, in particular to a method and an apparatus for calibrating a liquid crystal display device.

BACKGROUND OF THE INVENTION

With the development in thin film transistor liquid crystal display (TFT-LCD Display) and the progress of the industrial technology, the production cost of liquid crystal display device has been reduced, the manufacturing process is increasingly sophisticated, TFT-LCD has replaced the cathode ray tube display and become the mainstream technology in the field of flat panel display; moreover, due to its advantages, it is an ideal display device for the market and consumer. In the present market, liquid crystal display panels with various models and various sizes are very popular, while for liquid crystal display panels accepted by user, the technical shortcomings need to be solved urgently.

SUMMARY OF THE INVENTION

In order to improve the differences of display effect in angles, in the existing liquid crystal display, as shown in FIG. 1, the pixel electrodes 101*a*, 102*a* in adjacent rows 101, 102 of the display array is usually set to have different orientations (also known as the domain orientation). In this arrangement mode, observed from the side (i.e., in a direction inclined to the liquid crystal panel, such as in an inclined direction along the diagonal of the liquid crystal panel), a phenomenon of alternate bright and dark lines (also known as H-Line phenomenon) will be seen in the display, as shown in FIG. 2. Since the pixel electrodes in adjacent lines are usually set to have different domain orientations, in all the gray scales of the liquid crystal display, the above phenomenon can be observed from the side of the display. Human eyes are more sensitive to low gray scale, so the phenomenon of alternate bright and dark lines is particularly obvious when an image of low gray scale (i.e., with lower brightness) is displayed on the display.

In order to solve the above technical problem, the embodiment of the present invention provides a method for calibrating a liquid crystal display device; the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; the method comprises:

measuring brightness of the pixels of odd rows in a plurality of gray scales and brightness of the pixels of even rows in the plurality of gray scales respectively in a predetermined direction; and adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

Preferably, the step of adjusting comprises: calculating a reference brightness in a gray scale by using brightness of the pixels of odd rows and brightness of the pixels of even rows in the gray scale; adjusting brightness of the pixels of odd rows and brightness of the pixels of even rows to be equal to the reference brightness in each one of the plurality of gray scales.

Preferably, the step of adjusting further comprises: adjusting data line voltages of the pixels of odd rows and/or data line voltages of the pixels of even rows by using a relationship of voltage-transmittance of pixels of odd rows and/or pixels of even rows.

Preferably, the reference brightness is a mean value of brightness of the pixels of odd rows and brightness of the pixels of even rows in a gray scale.

Preferably, the number of the plurality of gray scales is 256.

Preferably, the electrodes are pixel electrodes.

Preferably, the predetermined direction is a viewing direction of a user.

The embodiment of the present invention further provides an apparatus for calibrating a liquid crystal display device; the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; wherein the apparatus comprises:

a measuring unit adapted for measuring brightness of the pixels of odd rows in a plurality of gray scales and brightness of the pixels of even rows in the plurality of gray scales respectively in a predetermined direction; and an adjusting unit adapted for adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

Preferably, the adjusting unit is adapted for: calculating a reference brightness in a gray scale by using brightness of the pixels of odd rows and brightness of the pixels of even rows in the gray scale; adjusting brightness of the pixels of odd rows and brightness of the pixels of even rows to be equal to the reference brightness in each one of the plurality of gray scales.

Preferably, the adjusting unit is adapted for: adjusting data line voltages of the pixels of odd rows and/or data line voltages of the pixels of even rows by using a relationship of voltage-transmittance of pixels of odd rows and/or pixels of even rows.

Preferably, the reference brightness is a mean value of brightness of the pixels of odd rows and brightness of the pixels of even rows in a gray scale.

Preferably, the number of the plurality of gray scales is 256.

Preferably, the electrodes are pixel electrodes.

Preferably, the predetermined direction is a viewing direction of a user.

The embodiment of the present invention further provides an instrument for calibrating a liquid crystal display device, the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; wherein the instrument comprises:

a measuring unit comprising a brightness measuring component and an angle controlling component; and an adjusting unit comprising a voltage regulating component connected with the liquid crystal display device.

Preferably, the angle controlling component is adapted for supporting the brightness measuring component.

Preferably, the brightness measuring component is a charge-coupled device.

Preferably, the voltage regulating component is connected with a data line driving circuit of the liquid crystal display device.

DETAILED DESCRIPTION OF THE INVENTION

The present invention will be described below in more detail in combination with the drawings and the embodiments. The following embodiments are used for explanation of the present invention, not for limitation of the scope of the present invention.

Though the invention uses wording of "pixel row", "row" to describe the solutions and the embodiments of the invention, but those skilled in the art understand, the solutions of the invention are also applicable for other liquid crystal display panels with the inclined orientations of electrodes being differentiated in columns.

To eliminate the H-Line phenomenon of the prior art, the embodiment of the present invention provides a method for calibrating a liquid crystal display device; the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; the method comprises:

measuring brightness of the pixels of odd rows in a plurality of gray scales and brightness of the pixels of even rows in the plurality of gray scales respectively in a predetermined direction; and adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

Figure 1:
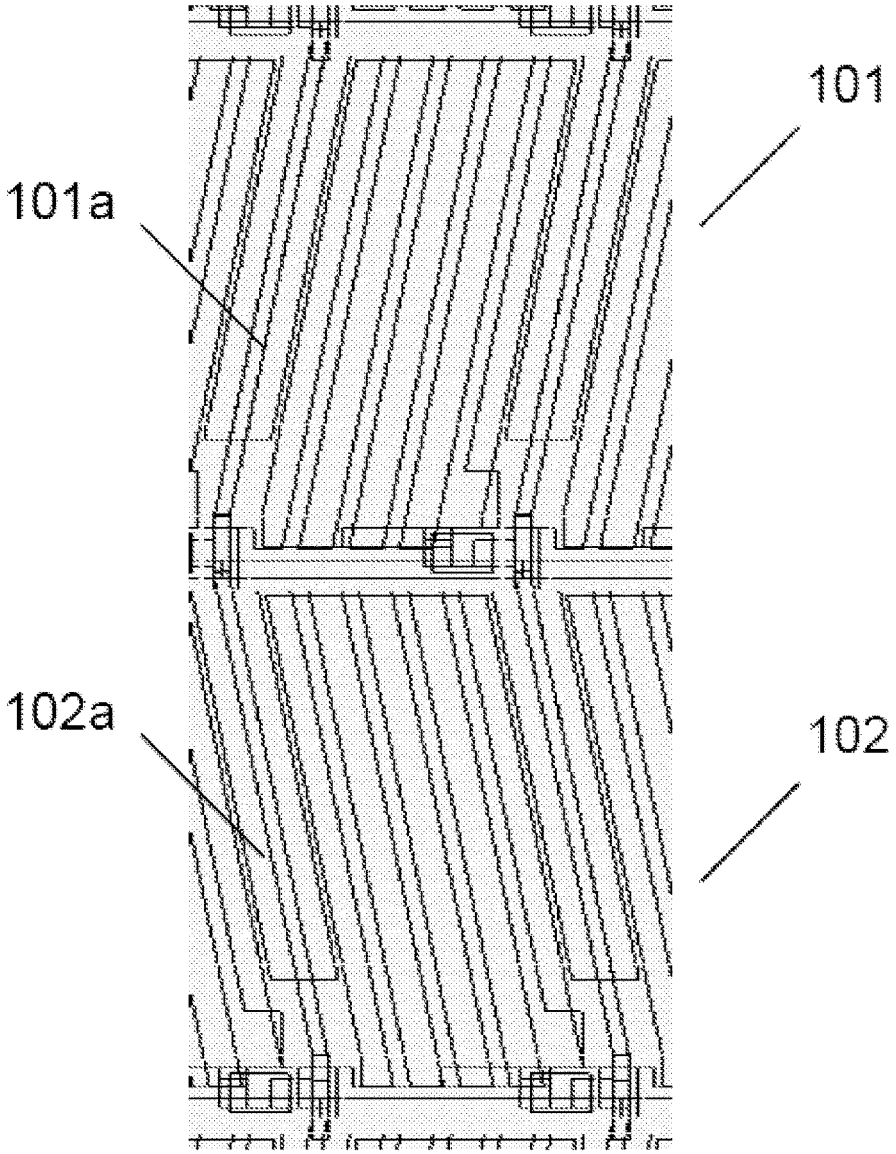
FIG. 1 is a schematic view of pixel electrodes in the prior art.
Figure 2:
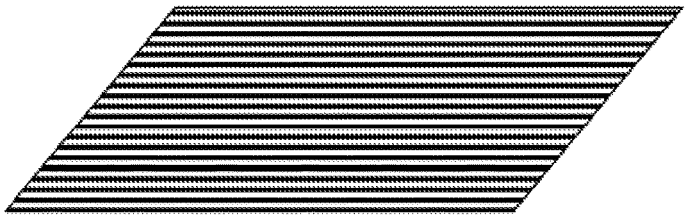
FIG. 2 is a schematic view of H-Line phenomenon in the prior art.
Figure 3:
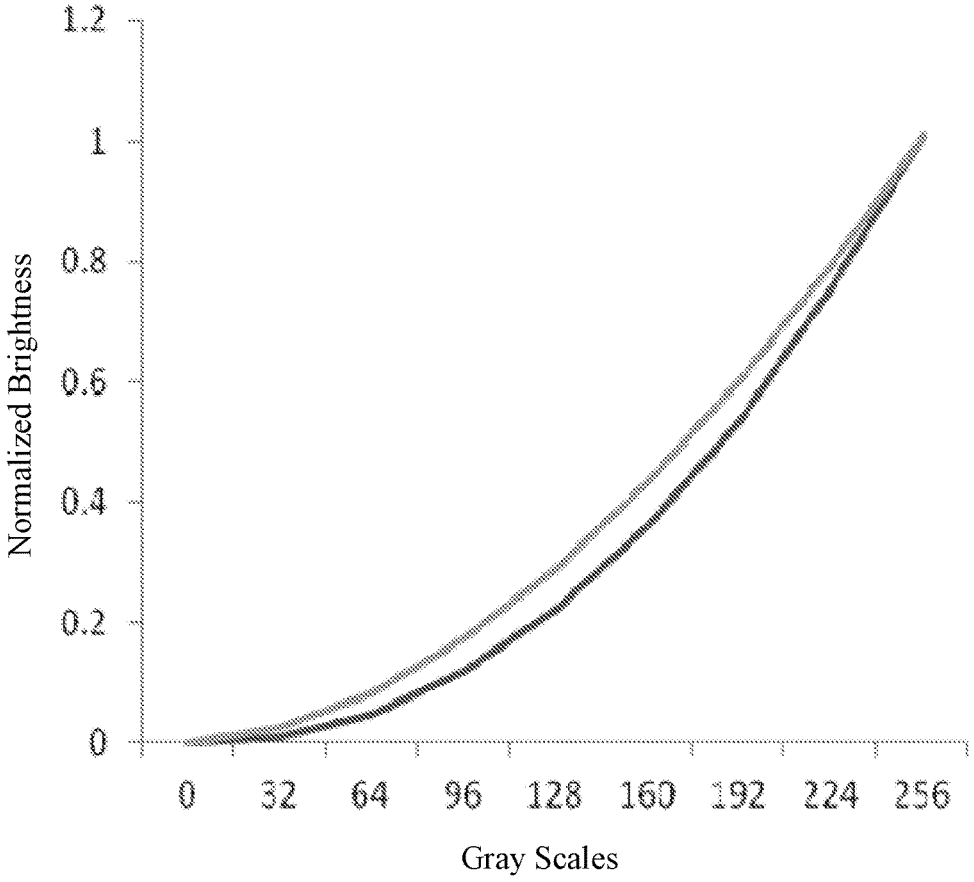
FIG. 3 is a schematic view of brightness difference between adjacent pixel rows measured in 256 gray scales respectively, wherein an inclined orientation of the electrodes in pixels of odd rows is different with an inclined orientation of the electrodes in pixels of even rows.

For the liquid crystal display with opposite electrode orientations in adjacent rows, the H-Line phenomenon can be seen in an inclined direction with respect to the liquid crystal panel; this is attributed to the different transmittances of respective pixel due to different inclined orientations of the electrodes. The inventor realizes that: in a predetermined direction (i.e., in a direction having a predetermined angle with respect to the normal direction of the liquid crystal panel), the brightness difference between adjacent rows can be calibrated by adjusting the data line voltages of pixels in each gray scale. FIG. 3 is a schematic view of brightness difference between adjacent pixel rows measured in 256 gray scales respectively, wherein an inclined orientation of the electrodes in pixels of odd rows is different with an inclined orientation of the electrodes in pixels of even rows. In FIG. 3, the horizontal axis represents ordinal numbers of gray scales; the vertical axis represents the normalized brightness. According to the method of calibrating a liquid crystal display device provided by the embodiment of the invention, the data line voltages of the pixels in odd rows and/or the data line voltages of the pixels in even rows are adjusted, so as to obtain images with same brightness in a predetermined direction for odd rows and even rows; the H-Line phenomenon is eliminated without loss of transmittance, and a display effect with consistent brightness is realized.

It should be noted that, the method of calibrating a liquid crystal display device provided by the embodiment of the invention can also be performed under different demands or scenes, to calibrate the same liquid crystal display device many times for different predetermined directions; thus the H-Line phenomenon can be eliminated for the liquid crystal display device successively in different predetermined directions under different demands or scenes.

Preferably, the step of adjusting comprises: calculating a reference brightness in a gray scale by using brightness of the pixels of odd rows and brightness of the pixels of even rows in the gray scale; adjusting brightness of the pixels of odd rows and brightness of the pixels of even rows to be equal to the reference brightness in each one of the plurality of gray scales.

Figure 4:
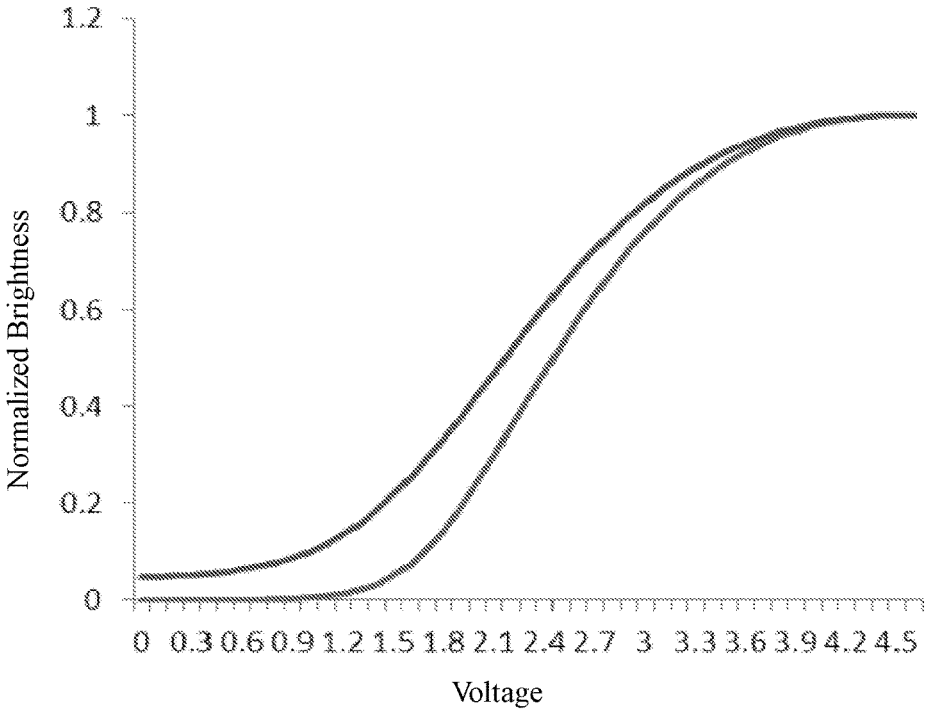
FIG. 4 is a schematic view of a relationship of voltage-transmittance of pixels in adjacent rows, wherein an inclined orientation of the electrodes in pixels of odd rows is different with an inclined orientation of the electrodes in pixels of even rows.

FIG. 4 is a schematic view of a relationship of voltage-transmittance of pixels in adjacent rows, wherein an inclined orientation of the electrodes in pixels of odd rows is different with an inclined orientation of the electrodes in pixels of even rows. In FIG. 4, the horizontal axis schematically represents voltage; the vertical axis represents the normalized brightness. The relationship of voltage-transmittance can be applied to control the data line voltage needed for each gray scale accurately. Therefore, preferably, the step of adjusting further comprises: adjusting data line voltages of the pixels of odd rows and/or data line voltages of the pixels of even rows by using a relationship of voltage-transmittance of pixels of odd rows and/or pixels of even rows.

Preferably, the reference brightness is a mean value of brightness of the pixels of odd rows and brightness of the pixels of even rows in a gray scale. The present invention is not limited to this; based on the same idea, e.g., if the brightness of the pixels in odd (even) rows is always higher than the brightness of the pixels in even (odd) rows (as shown in FIG. 4), adjustment can be performed under each gray scale only for the pixels in odd (even) rows, such that the brightness of the pixels in odd (even) rows can be reduced to the brightness of the pixels in even (odd) rows.

Preferably, the number of the plurality of gray scales is 256. Though, in the embodiments of the present invention, 256 gray scales are described as an example, those skilled in the art can understand that the present invention is also applicable for the liquid crystal display devices with other gray scale numbers.

Preferably, the electrodes are pixel electrodes. Those skilled in the art can understand that the methods of the embodiments of the present invention are also applicable for the calibration of liquid crystal display devices, in which liquid crystal display devices the common electrodes are arranged on the light-exiting side, and the orientations of the common electrodes alternate in adjacent rows. Likewise, based on the idea of the present invention, the methods of the embodiments of the present invention are also applicable for calibrating the brightness difference of several rows (columns, or, pixels) in a same gray scale, which brightness difference is caused by arrangement difference of electrodes in pixels.

Figure 5:
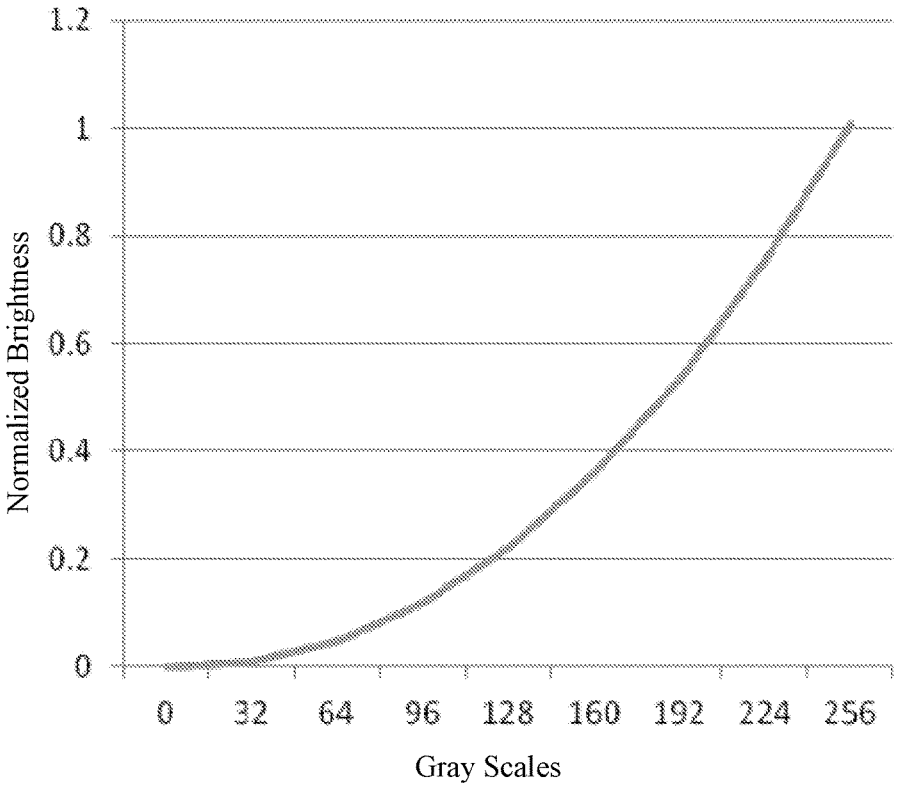
FIG. 5 is a schematic view of brightness curves of adjacent rows after the method for calibrating a liquid crystal display device according to an embodiment of the present invention is performed.

FIG. 5 is a schematic view of brightness curves of adjacent rows after the method for calibrating a liquid crystal display device according to an embodiment of the present invention is performed. In FIG. 5, the horizontal axis represents ordinal numbers of gray scales; the vertical axis represents the normalized brightness. It can be seen that after the calibration, in the predetermined direction, the brightness curves of the adjacent rows overlap with each other; that is, the difference between the brightness of adjacent rows has been eliminated.

Preferably, the predetermined direction is a viewing direction of a user.

The embodiment of the present invention further provides an apparatus for calibrating a liquid crystal display device; the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; wherein the apparatus comprises:

a measuring unit adapted for measuring brightness of the pixels of odd rows in a plurality of gray scales and brightness of the pixels of even rows in the plurality of gray scales respectively in a predetermined direction; and an adjusting unit adapted for adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

Preferably, the adjusting unit is adapted for: calculating a reference brightness in a gray scale by using brightness of the pixels of odd rows and brightness of the pixels of even rows in the gray scale; adjusting brightness of the pixels of odd rows and brightness of the pixels of even rows to be equal to the reference brightness in each one of the plurality of gray scales.

Preferably, the adjusting unit is adapted for: adjusting data line voltages of the pixels of odd rows and/or data line voltages of the pixels of even rows by using a relationship of voltage-transmittance of pixels of odd rows and/or pixels of even rows.

Preferably, the reference brightness is a mean value of brightness of the pixels of odd rows and brightness of the pixels of even rows in a gray scale.

Preferably, the number of the plurality of gray scales is 256.

Preferably, the electrodes are pixel electrodes.

Preferably, the predetermined direction is a viewing direction of a user.

The embodiment of the present invention further provides an instrument for calibrating a liquid crystal display device, the liquid crystal display device comprises a pixel array, each pixel of the pixel array comprises electrodes in inclined arrangement, wherein an inclined orientation of the electrodes in pixels of odd rows is different with an inclined orientation of the electrodes in pixels of even rows; wherein the instrument comprises:

a measuring unit comprising a brightness measuring component and an angle controlling component; and an adjusting unit comprising a voltage regulating component connected with the liquid crystal display device.

To eliminate the H-Line phenomenon, the measuring unit is adapted for measuring brightness of the pixels of odd rows in a plurality of gray scales and brightness of the pixels of even rows in the plurality of gray scales respectively in a predetermined direction; and the adjusting unit is adapted for adjusting data line voltages of the pixels of odd rows and/or data line voltages of the pixels of even rows, such that in the predetermined direction, in each one of the plurality of gray scales, brightness of the pixels of odd rows is equal to brightness of the pixels of even rows.

Preferably, the angle controlling component is adapted for supporting the brightness measuring component, such that the brightness measuring component can perform the measurement in any predetermined directions.

Preferably, the brightness measuring component is a charge-coupled device.

Preferably, the voltage regulating component is connected with a data line driving circuit of the liquid crystal display device, so as to modify (i.e., adjust) data line voltages of the pixels of odd rows and/or data line voltages of the pixels of even rows.

For the liquid crystal display device calibrated by the above mentioned methods and the electronic equipment comprising the liquid crystal display device, images with same brightness in a predetermined direction can be obtained for odd rows and even rows; the H-Line phenomenon is eliminated without loss of transmittance, and a display effect with consistent brightness is realized.

The above embodiments are only used for explanations rather than limitations to the present invention, the ordinary skilled person in the related technical field, in the case of not departing from the spirit and scope of the present invention, may also make various modifications and variations, therefore, all the equivalent solutions also belong to the scope of the present invention, the patent protection scope of the present invention should be defined by the claims.

What is claimed is:

1. A method of calibrating a liquid crystal display device comprising the steps of:

measuring a first brightness of an odd row of pixels of the liquid crystal display device from a predetermined direction for each of a plurality of gray scales, the odd row of pixels having a first data line voltage that can be adjusted to adjust the first brightness of the odd row of pixels;

measuring a second brightness of an even row of pixels of the liquid crystal display device from the predetermined direction for each of the plurality of gray scales, the even row of pixels having a second data line voltage that can be adjusted to adjust the second brightness of the even row of pixels; and adjusting at least one of the first data line voltage and the second data line voltage;

wherein the first data line voltage corresponds to the first brightness of an odd row of pixels through a first voltage-transmittance ratio;

wherein the second data line voltage corresponds to the second brightness of an even row of pixels through a second voltage-transmittance ratio;

wherein the first brightness and the second brightness are equal for each of the plurality of gray scales when measured from the predetermined direction; and wherein the liquid crystal display device comprises a pixel array having a plurality of odd rows of pixels and a plurality of even rows of pixels, wherein each pixel of the pixel array comprises one or more electrodes oriented at an angle to a row of pixels, wherein the electrodes of an odd row of pixels have a first orientation and the electrodes of an even row of pixels have a second orientation different from the first orientation.

2. The method of calibrating a liquid crystal display device according to claim 1, wherein the step of adjusting comprises:

calculating a reference brightness for each of a plurality of gray scales from the first brightness and the second brightness; and adjusting at least one of the first data line voltage and the second data line voltage such that the first brightness and the second brightness are equal to the reference brightness for each of the plurality of gray scales when measured from the predetermined direction.

3. The method of calibrating a liquid crystal display device according to claim 2, wherein the reference brightness is a mean value of the first brightness and the second brightness for each of a plurality of gray scales when measured from the predetermined location.

4. The method of calibrating a liquid crystal display device according to claim 1, wherein the quantity of the plurality of gray scales is 256.

5. The method of calibrating a liquid crystal display device according to claim 1, wherein the electrodes are pixel electrodes.

6. The method of calibrating a liquid crystal display device according to claim 1, wherein the predetermined direction is a viewing direction of a user.

7. An apparatus for calibrating a liquid crystal display device comprising:

a measuring unit adapted for measuring both a first brightness of an odd row of pixels of the liquid crystal display device from a predetermined direction for each of a plurality of gray scales, the odd row of pixels having a first data line voltage that can be adjusted to adjust the first brightness of the odd row of pixels; and a second brightness of an even row of pixels of the liquid crystal display device from the predetermined direction for each of the plurality of gray scales, the even row of pixels having a second data line voltage that can be adjusted to adjust the second brightness of the even row of pixels; and an adjusting unit adapted for adjusting at least one of the first data line voltage and the second data line voltage;

wherein the first data line voltage corresponds to the first brightness of an odd row of pixels through a first voltage-transmittance ratio;

wherein the second data line voltage corresponds to the second brightness of an even row of pixels through a second voltage-transmittance ratio;

wherein the first brightness and the second brightness are equal for each of the plurality of gray scales when measured from the predetermined direction; and wherein the liquid crystal display device comprises a pixel array having a plurality of odd rows of pixels and a plurality of even rows of pixels, wherein each pixel of the pixel array comprises one or more electrodes oriented at an angle to a row of pixels, wherein the electrodes of an odd row of pixels have a first orientation and the electrodes of an even row of pixels have a second orientation different from the first orientation.

8. The apparatus for calibrating a liquid crystal display device according to claim 7, wherein:

the adjusting unit is adapted for a reference brightness for each of a plurality of gray scales from the first brightness and the second brightness; and adjusting at least one of the first data line voltage and the second data line voltage such that the first brightness and the second brightness are equal to the reference brightness for each of the plurality of gray scales when measured from the predetermined direction.

9. The apparatus for calibrating a liquid crystal display device according to claim 7, wherein the reference brightness is a mean value of the first brightness and the second brightness for each of a plurality of gray scales when measured from the predetermined location.

10. The apparatus for calibrating a liquid crystal display device according to claim 7, wherein the quantity of the plurality of gray scales is 256.

11. The apparatus for calibrating a liquid crystal display device according to claim 7, wherein the electrodes are pixel electrodes.

12. The apparatus for calibrating a liquid crystal display device according to claim 7, wherein the predetermined direction is a viewing direction of a user.

* * * * *